US005263352A

United States Patent [19]

Yano

[11] Patent Number: 5,263,352

[45] Date of Patent: Nov. 23, 1993

[54] COMBINATION DIE ASSEMBLY AND A METHOD OF EXTRUSION USING THE DIE ASSEMBLY

[75] Inventor: Sadahide Yano, Osakashi, Japan

[73] Assignee: Yugen Kaisha Yano Engineering, Osaka, Japan

[21] Appl. No.: 20,984

[22] Filed: Feb. 22, 1993

[30] Foreign Application Priority Data

Feb. 27, 1992 [JP] Japan ..... 4-041496
Jul. 6, 1992 [JP] Japan ..... 4-178082

[51] Int. Cl.[5] ..... B21C 25/04
[52] U.S. Cl. ..... 72/269
[58] Field of Search ..... 72/264, 269

[56] References Cited

U.S. PATENT DOCUMENTS 2,366,344 10/1940 McFadden .
3,213,662 7/1963 Lenz .
3,527,079 8/1966 Braeuninger .
4,313,327 2/1982 O'Connor .

FOREIGN PATENT DOCUMENTS 398747 5/1990 European Pat. Off. .
489169 12/1918 France .

*Primary Examiner*—Lowell A. Larson
*Attorney, Agent, or Firm*—Collard & Roe

[57] ABSTRACT

The combination die assembly comprises male die which is composed of a core 12 formed with at least one opening 16 piecing the body portion of the core, a stopping pin 13 having its side ends 13*a* protruding from the opening, and a mold 14 for holding the core 12. The mold 14 is formed with a core-holding aperture 21 having inside shoulders which bear the side ends 13*a* of the pin 13, so that the core 12 is easily manufactured, any undesirable stress concentration onto the member for support of the core is avoided, and the reliability in mechanical strength of the core is improved.

9 Claims, 11 Drawing Sheets

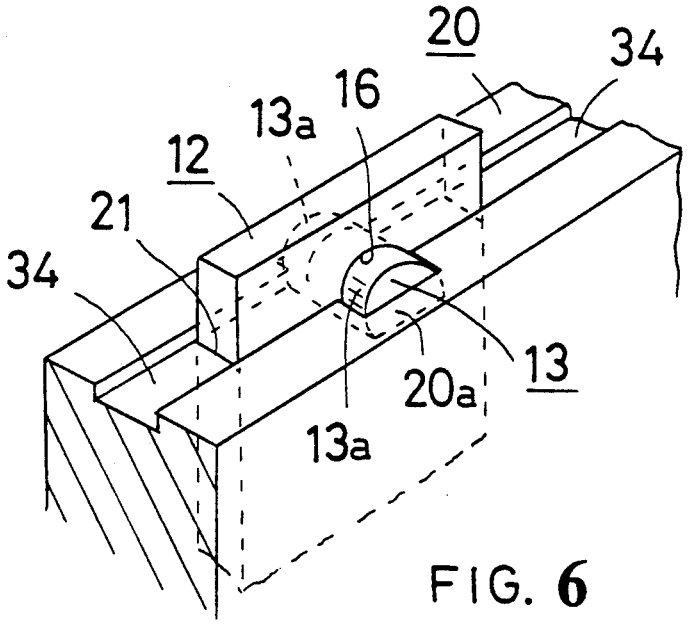
FIG. 6
FIG. 7a
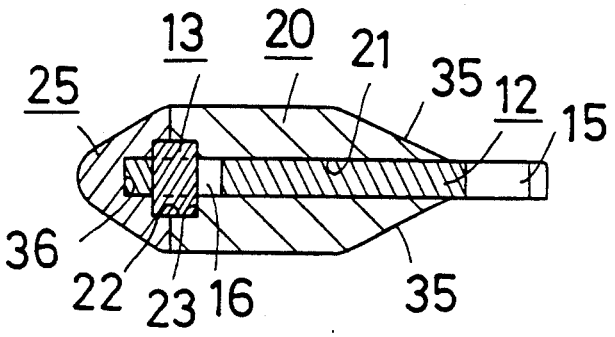
FIG. 7b
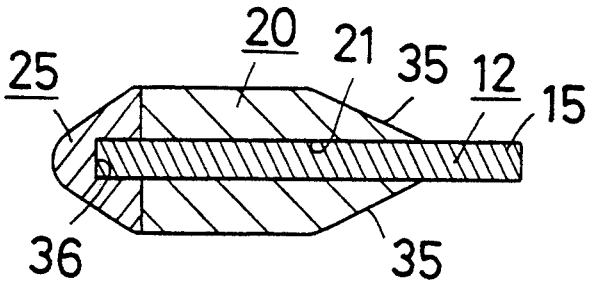
FIG. 7c
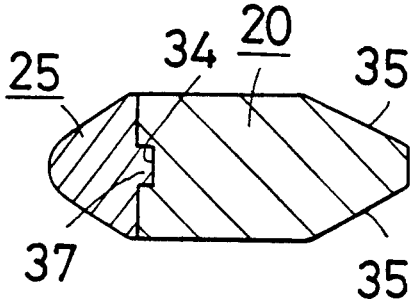

COMBINATION DIE ASSEMBLY AND A METHOD OF EXTRUSION USING THE DIE ASSEMBLY

BACKGROUND OF THE INVENTION

1. Technical Field of the Invention

The present invention relates to a combination die assembly which comprises a female die and a male die combined with the female die and is adapted for use in extruding small-, medium- or large-sized articles such as the multi-bored flat tubes in a heat exchanger made of aluminum or its alloy, and also the present invention relates to a method of extruding such articles by using the combination die assembly.

2. Prior Art

FIG. 12 shows an example of aluminum tubes which constitute a heat exchanger employed for instance in the air conditioning system. Among the various methods of manufacturing such a tube 1, the extrusion method is advantageous in that a high pressure resistance can be enhanced to the tube.

The die assembly, for example the so-called "porthole" die, used to extrude the tubes comprises in general a male die and a female die. The male die forms a hollow space extending through the tube 1, whereas the female die forms a periphery of said tube.

Since the multi-bored hollow and flat tubes 1 for the heat exchanger have a width "B" of 10-20 mm and a height "H" of 3-7 mm, the die assembly must be of a high precision despite its small size. Therefore, efforts have been made for a higher mechanical strength of the die assembly by improving its material. It is required that the repeated replacement of a worn die assembly with a new one does not unreasonably raise the running cost, and also that such a small-sized die assembly can be manufactured easily not to raise said cost. For this purpose, an improved male die 52 was already proposed, which die comprises separable parts as shown in FIG. 14*a* and has been used in combination with a female die 51. The male die 52 is composed of: a core 54 having portions 53 to form the hollow regions through the tube; and a mold 55 which holds the core 54 in place. Similar improvement is also being made for a larger die assembly extruding the medium- or large-sized particles.

Various structures have been proposed to let the core 54 be surely and precisely set in the mold 55 of the composite male die in a combination die assembly.

According to the proposal illustrated in FIG. 14*a*, the male die 52 has such a core 54 that is generally flat but is formed with a pair of ears 60. Each ear 60 integrally protrudes from the outer end of the core 54 in the direction of its thickness. A core-holding aperture 58 is formed through the mold 55 so as to receive the core 54, wherein its ears 60 rest on and are thus supported by shoulders which are formed in the aperture 58.

In a further proposal shown in FIG. 14*b*, the core 54 in the male die 52 has ears 57 integrally extending from the opposite sides at the outer end of the core. Those ears 57 are likewise supported by similar shoulders disposed in the core-holding aperture 58 of the mold 55.

In a still further proposal shown in FIG. 14*c*, the core 54 has opposite sides which are tapered to reduce the width of said core towards its inner end. The core receiving aperture 58 is also tapered at its sides so as to tightly engage with the tapered sides of the core.

As will be seen in the structure shown in FIG. 14*a*, the core 54 having the ears 60 protruding in the direction of thickness will render the core stereoscopic and somewhat complicated in shape. Consequently, it is not easy to manufacture the core at a reasonable cost. There is a likelihood that stress is concentrated at a corner between the core and either or both ears 60 during the extrusion process. Such a concentrated stress will produce a crack in the corner region, thus impairing the reliability in mechanical strength of the combination die assembly.

Although the core 54 shown in FIG. 14*b* can be more easily manufactured from a flat plate, there is a higher possibility that cracks are produced in the root portion of the ears 57, thereby breaking same early. This will result not only in a much lower reliability of the die assembly but also necessitate many replacements therefor.

In a further proposal shown in FIG. 14*c*, an extremely high precision must be ensured for the tapered portions of the core 54 which fits in the aperture formed through the mold 55, in order that the core can be positioned as accurate as possible relative to the mold with respect to the direction of extrusion. This requirement raises the manufacture cost of the combination die assembly.

SUMMARY OF THE INVENTION

An object of the present invention, which was made to resolve the problems inherent in the prior art extrusion die assembly, is therefore to provide a combination die assembly adapted for extrusion of a metallic material and comprising a female die and a male die, which male die is composed of a mold and a core capable of being separably held in the mold, wherein the core is of such a structure that it can be manufactured easily without any extraordinarily high precision of machining and can nevertheless ensure a high reliability to the die assembly.

Another object of the invention is to provide a method of extruding a metallic material through a combination die assembly which comprises a female die and a male die composed of a mold and a core capable of being separably held in the mold, in such a manner that a lower running cost can be realized for an extrusion process of the metallic material.

Further objects and advantages of this invention will become clear in the embodiments which will be given hereinafter only by way of examples to demonstrate the preferred modes. Therefore, this invention is not limited to these embodiments but permits many other modifications falling within the range and spirit of the invention.

In order to achieve the object, the present invention provides a combination die assembly adapted for extrusion of a metallic material or the like (hereinafter referred to as "metallic material") and comprising a female die for forming a periphery defining a hollow and elongate article as well as a male die which mates the female die to form at least one hollow space extending through the elongate article, the male die comprising: a core having at its inner end at least one projected portion of such a shape as defining the hollow space and further having at least one pierced opening through or at least one engraved recess on a body portion of the core; at least one stopping member disposed through the opening or in the recess of the core such that at least one side end of the stopping member protrude sideways from the side surface of the body portion of the core; a mold having a core-holding aperture which is formed through the male die so as to extend from an outer extremity to an inner extremity thereof; and, at least one shoulder formed in the core-holding aperture and on inner wall surface so as to face the male die's outer extremity which is disposed upstream of a flow of extruded metallic material, wherein the core is inserted in the core-holding aperture in such a state that the side end of the stopping member is born by the shoulder of said aperture so that the core is kept in place within the mold.

The stopping member or each of the stopping members may preferably be a pin which is disposed through the opening or in the recesses of the core, and side ends of the pin protrude sideways from the core so as to be born by the shoulders.

It is also preferable that the pin as the stopping member has its outer portion which partially protrudes outwards from, or is disposed close to, an outer surface area of the mold which area defines the entrance of the core-holding aperture (as shown in a second embodiment described hereinafter).

It is desirable that at least an outer region (that is, an "upstream" region in the meaning just referred to above) of inner periphery of each opening or recess is arcuate. Correspondingly, at least an outer region of outer periphery of each pin is arcuate in this case at its portion disposed in the opening or recess.

The arcuate outer region of the pin periphery may extend beyond its semicircumference.

The core may be made of an especially hard and durable material such as a "hard metal" ( that is, cemented carbide), a ceramics or the like.

The core-holding aperture may be formed through a bridging member which may be disposed across a flow path formed through the mold and allowing the metallic material to be extruded therethrough. A rear cover disposed in rear of the bridging member may have on its front region one or more such lugs or recesses that engage with corresponding recesses or lugs on the rear region of said member, whereby said cover is kept in right position relative to the bridging member.

From another aspect, the present invention provides also a method of extruding a metallic substance or the like (hereinafter simply and generally referred to as "metallic material"), the method comprising the steps of: preparing a combination die assembly which is composed of: a female die for forming a periphery defining a hollow and elongate article; and a male die which mates the female die to form at least one hollow space extending through the elongate article, the male die comprising: a core having at its inner end at least one projected portion of such a shape as defining the hollow space and further having at least one pierced opening through or at least one engraved recess on a body portion of the core; at least one stopping member disposed through the opening or in the recess of the core such that at least one side end of the stopping member protrude sideways from the side surface of the body portion of the core; a mold having a core-holding aperture which is formed through the male die so as to extend from an outer extremity to an inner extremity thereof; and at least one shoulder formed in the core-holding aperture and on inner wall surface so as to face the male die's outer extremity which is disposed upstream of a flow of extruded metallic material; inserting the core into the core-holding aperture in such a state that the side end of the stopping member is born by the shoulder of said aperture so that the core is kept in place within the mold; and then extruding the metallic material through the combination die assembly.

The stopping member or each of the stopping members which constitute the die assembly used in the method may preferably be a pin which is disposed through the opening or in the recesses of the core, and side ends of the pin protrude sideways from the core so as to be born by the shoulders.

BRIEF DESCRIPTION OF THE DRAWINGS

In the drawings showing embodiments of the present invention;

FIG. 6 is a perspective view showing partly in section the state of a core which is included in the die assembly in FIG. 3*a* and is held in place;

FIG. 7*a* is a cross section taken along the line 5—5 in FIG. 5;

FIG. 7*b* is another cross section taken along the line 6—6 in FIG. 5;

FIG. 7*c* is still another cross section taken along the line 7—7 in FIG. 5;

DETAILED DESCRIPTION OF PREFERRED EMBODIMENTS

Figure 12:
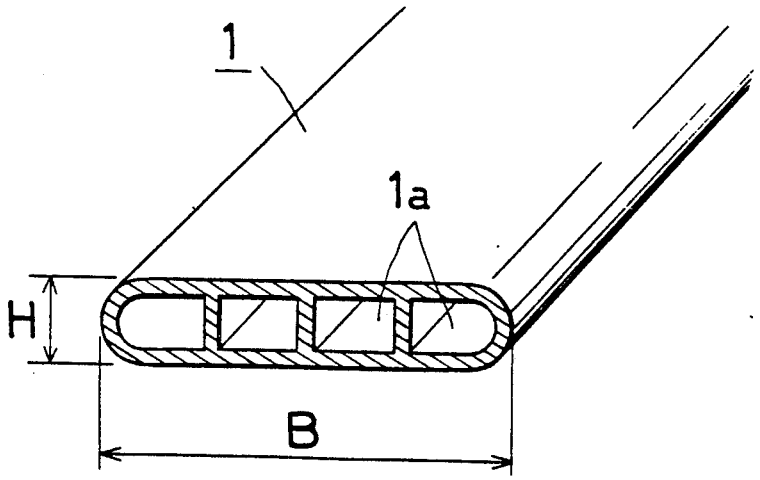
FIG. 12 is a perspective and cross-sectional view of a product which may be manufactured using the die assembly and may be used as a heat-exchanging tube.

The preferred embodiments of the present invention directed to a combination die assembly and a method of extruding an aluminum tube 1 by means of the die assembly will now be described in detail, wherein the aluminum tube 1 as shown in FIG. 12 may be such as employed in a heat exchanger.

It will be understood that the present invention is applicable not only to the heat exchanger tubes but also to the extrusion on any other small-, medium- or large-scaled articles, insofar as a combination die assembly is employed which comprises a male die mating a female die, with the male die being composed of a separable core and a mold adapted to hold the core in place.

First Embodiment

Figure 1B:
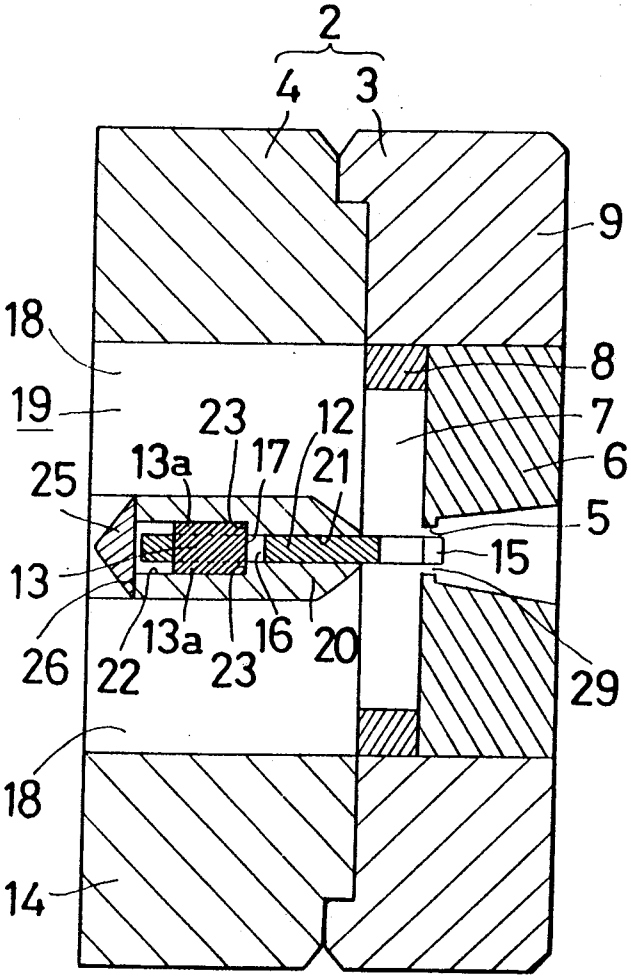
FIG. 1*b* is a cross section taken along the line 1—1 in FIG. 1*a;*
Figure 1A:
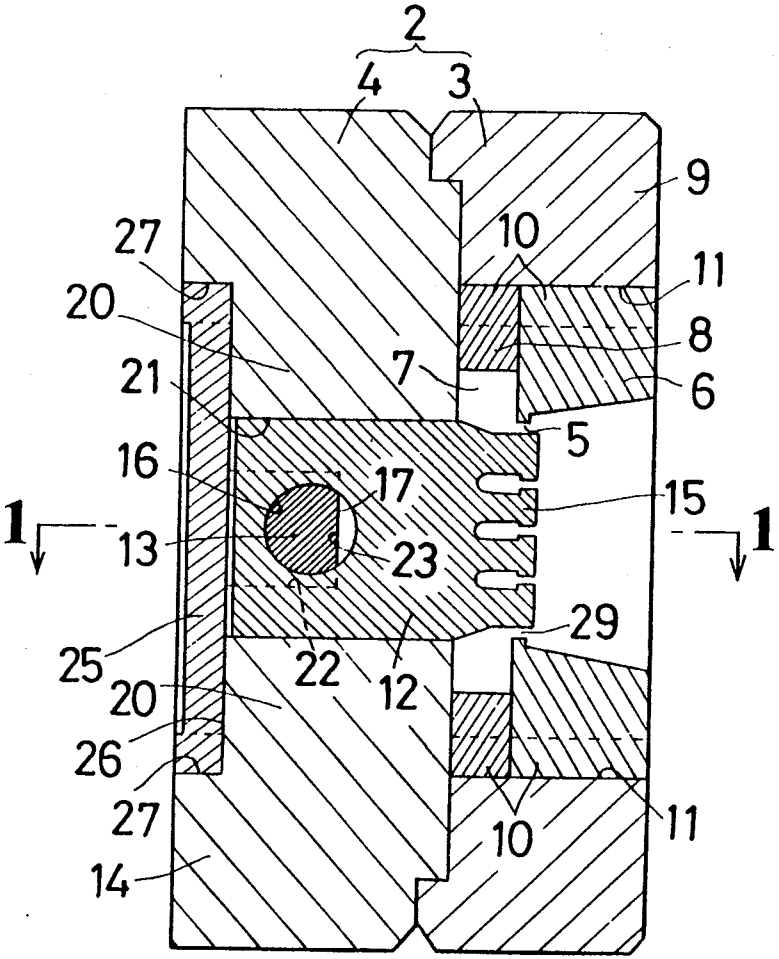
FIG. 1*a* is a horizontal cross section of a combination die assembly provided in a first embodiment.
Figure 2:
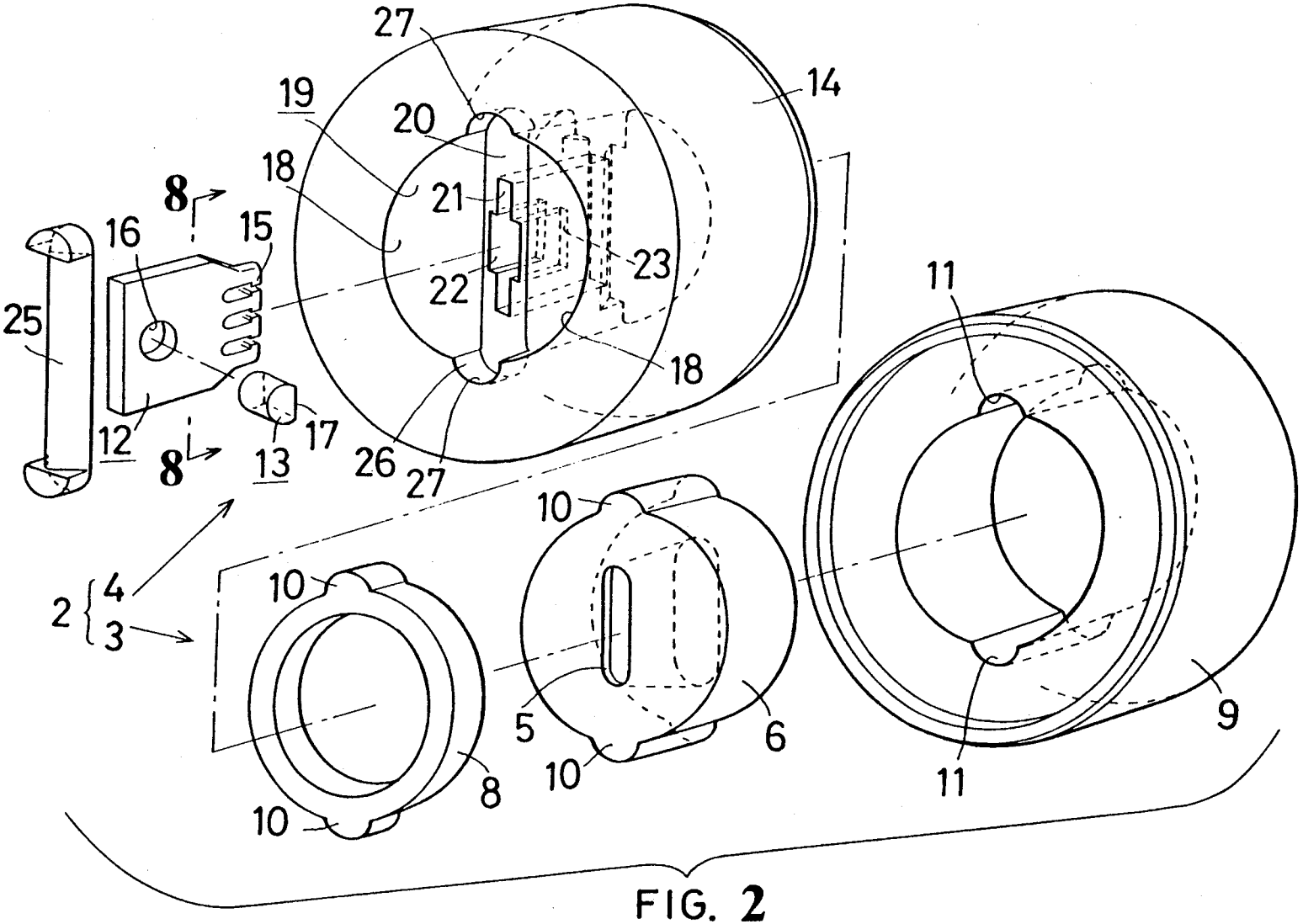
FIG. 2 is a perspective view showing the disassembled state of the combination die assembly shown in FIG. 1*a;*

A combination die assembly 2 shown in FIGS. 1*a* to 2 comprises a female die 3 and a male die 4.

The male die 4 is composed of a core 12, a pin 13 as a stopping member, a mold 14 for holding in place the core, and a rear cover 25.

The core 12 may be produced by manufacturing a flat raw plate of a die steel, a hard metal, a ceramics or the like. The core 12 has at its inner end a plurality of projected portions 15 which are arranged in a comb-like pattern to form hollow spaces 1*a* which extend longitudinally of the tube 1. The projected portions may be formed by any conventional method such as the electron discharge method (abbr. "EDM"). A circular pierced opening 16 is formed transversely of and at a middle height of the core, through its flat region and near its outer end. This opening may be formed using the so-called "wire cut electric spark machine".

Figure 8A:
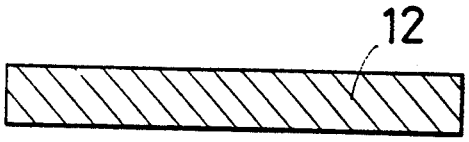
FIGS. 8*a* through 8*g* are cross sections taken along the line 8—8 in FIG. 2 or FIG. 4 and showing various examples of the core.
Figure 8B:
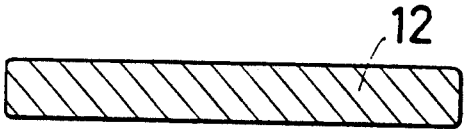
Figure 8C:
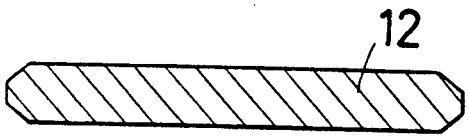
Figure 8D:
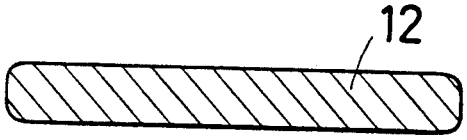
Figure 8E:
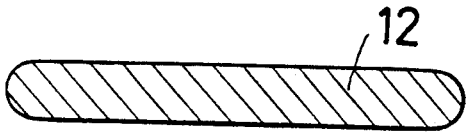
Figure 8F:
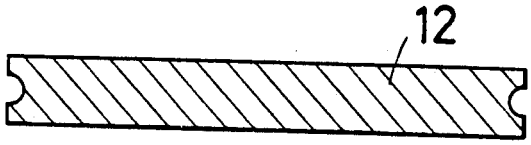
Figure 8G:
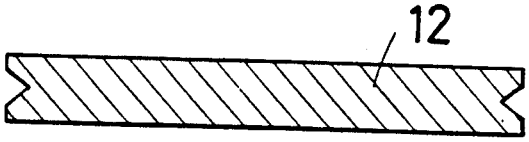

The core 12 may have a rectangular cross section as shown in FIG. 8*a*, wherein four corners are acute and right-angled at its portion intermediate the inner and outer ends. The corners may however be chamfered, obtuse or rounded in any manner shown in FIGS. 8*b* to 8*e* so as to avoid the stress concentration at the corners and to thus protect the core 12 from breakage. Alternatively, the core may be of such a shape as shown in FIG. 8*f* or 8*g*.

The stopping pin 13 shown in FIGS. 1*a* to 2 may be made from a columnar raw piece of the same material as the core 12. A flat cut surface 17 extends the full axial length of and axially of the pin in such a state that its outer periphery remains arcuate and extends beyond its semicircumference in cross section. The pin 13 has a length greater than the thickness of the core 12, whereby both side ends of the pin protrude outwardly of the core when inserted in the pierced opening 16. Diameter of the pin 13 is substantially equal to or slightly smaller than the diameter of the opening 16 formed through the core 12, so that the pin 13 can tightly fit in the opening 16.

The mold 14 for receiving and holding the core is formed with a material flow path 19 which extends centrally and axially of a columnar raw piece from which the mold is manufactured. A bridging member 20 integral with the mold 14 is disposed across the flow path 19 and divides it into two distributaries 18 and 18. A core-holding aperture 21 penetrates the bridging member 20 in the direction of extruded raw material so as to receive and keep the core 12 in accurate place.

Inner wall surfaces of the aperture 21 are shaped such that its contour substantially coincides as a whole with the cross section of the core 12. Thus, the core 12 can almost tightly fit in the core-holding aperture 21.

Guide grooves 22 are formed symmetrically on the facing inner walls at the middle height of the core-holding aperture 21. Those grooves 22 extend a given distance from the outer end towards the inner end of the bridging member, but terminate short of said inner end to thereby provide flat shoulders 23 and 23, respectively. Width, or vertical size, of the grooves 22 corresponds to the diameter of stopping pins 13, like a "mortise" for a "tenon". Therefore, both the side ends of pin 13 are guided by the grooves 22 when the pin is fitted deep in the aperture 21.

The rear or outer end surface of the bridging member 20 is located inwardly of the outer end surface of the mold 14 so that a space 26 for receiving a rear cover 25 is preserved outwardly of the bridging member. In order to prevent the cover 25 from rotating within the space, retaining recesses 27 formed at opposite ends of the space do extend from the outer end of the mold to the outer end of the bridging member.

The rear cover 25 is of an elongated-oval or elliptic shape when seen from its rear side, which in turn is convex rearwardly so that the extruded material is divided to flow smooth into the distributaries 18 in the mold 14.

The male die 4 may be assembled by inserting at first the stopping pin 13 in and through the pierced opening 16 of the core 12. The flat cut surface 17 of the pin 13 must face the inner portion of the core with respect to the flow direction of extruded material. The core 12 is then pushed forward (i.e., inwardly) to slide into the core-holding aperture 21, until the pin's side ends 13*a* come into contact with and are pressed to the shoulders 23 within the aperture 21. In this way, the core 12 takes its correct position in the fore and aft direction relative to the mold 14, whereby the projected inner end portions 15 of the core 12 are disposed ahead a given distance from the innermost end surface of the mold 14. Subsequently, the rear cover 25 is fitted in the rear space 26 of the mold 14 and welded or otherwise secured thereto.

The male die 4 which is assembled in the described manner will be combined with the female die 3 to provide the combination die assembly 2. A continuous slit 29 is defined between the inner end portions 15 of the core 12 and an inner periphery of the female die's hole 5. The configuration of the slit corresponds to the cross-sectional shape of extruded tube 1. Such a combination die assembly is then mounted on an extruder, and an aluminum billet, any other raw metallic material or the like will be forced through and forwardly of the die assembly to continuously form a multi-bored flat tube 1.

The female die 3 comprises a main body 6, a ring-like member 8 and a cylindrical mold 9 for receiving those body 6 and member 8. The main body 6 has a central hole 5 which is of such an elliptic shape as defining the outer periphery of the tube 1. The ring-like member 8 is disposed rearwardly of and in contact with the upstream surface of main body 6 to thereby provide a fusion chamber 7. In this chamber, separate streams of the raw metal forced through the male die 4 will be inseparably fused together. Both the main body 6 and ring-like member 8 have axially extending lugs which are fittable in axial grooves 11 formed on the inner periphery of the mold 9, so that the body 6 and member 8 are not allowed to rotate and their position within the mold in the other directions can also be easily controlled. (The angular relationship between the male die and female die is also regulated by a suitable means not shown.)

In the combination die assembly 2 described above, the core 12 of the male die 4 is simpler in shape because it need to have only the pierced opening 16 in order to be held accurately in place by the mold 14. Therefore, the core can be manufactured easily at a lowered cost, and the manufacture cost of the die assembly in entirety as well as the running cost for extruding the raw material are also reduced to a remarkable degree. Such a simple structure of the core is further advantageous in that it can be manufactured from a super-hard material such as the hard metal, ceramics or the like.

Figure 14A:
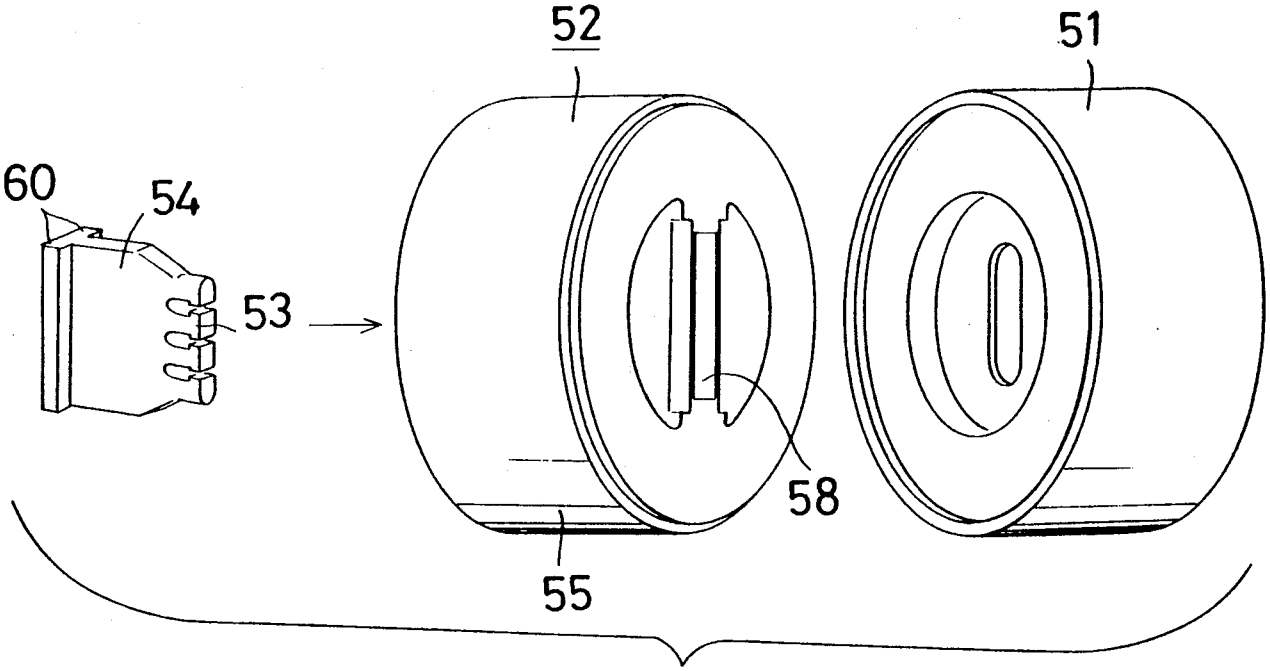
FIG. 14a (PRIOR ART)
FIG. 14*a* is a perspective view showing a prior art die assembly in its disassembled state.
Figure 14C:
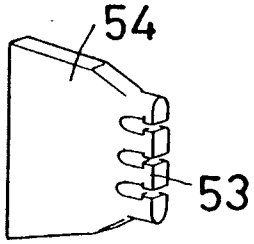
FIG. 14c (PRIOR ART)
FIGS. 14*b* and 14*c* show modifications of a core incorporated in the prior art die assembly.
Figure 14B:
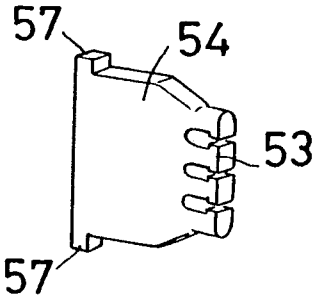
FIG. 14b (PRIOR ART)

Further, since the tapered engagement structure as shown in FIG. 14*c* is no more necessary for the core to be held in place, any extraordinarily high precision is not required herein wherein manufacturing the male die. This is an additional effect to lower the manufacture cost of producing the core.

This core 12 supported by the stopping pin 13 improves the reliability in the mechanical strength of the structure, thus lightening the labor for replacing the worn or broken core with a new one.

Particularly, the circular inner periphery of the pierced opening 16 tightly fits on and is supported by the arcuate periphery zone of the columnar pin 13 during the extrusion process. This is effective to avoid an excessive concentration of stress at the point where the core 12 is supported, thereby enhancing a higher durability to the combination die assembly 2. It is also to be noted that the core 12 can swing slightly about the stopping pin 13 so as to be automatically and smoothly centered relative to the members or portions present in the vicinity of core, thus ensuring an excellent performance of the die.

The other advantages are as follows. The arcuate region of the pin's periphery except for the flat surface portion 17 does extend beyond the semicircumference, and therefore the side ends of the pin 13 can be kept in a fitting contact with and be received almost wholly in the guide grooves 22, even if the flat surface portion 17 is not positioned in absolute parallel with the shoulders 23 in the core-holding aperture 21. In other words, the core 12 maintains always and in any case its correct position without any intolerable displacement, during the extrusion process. Due to this feature, the core 12 is protected well from breakage or other damage which would otherwise be caused by its undesirable displacement within the mold.

Since the flat surface portion 17 extend the full length of the pin 13, the both side ends of the pin 13 can stably and surely bear against the shoulders 23 in the aperture 21.

Figure 9:
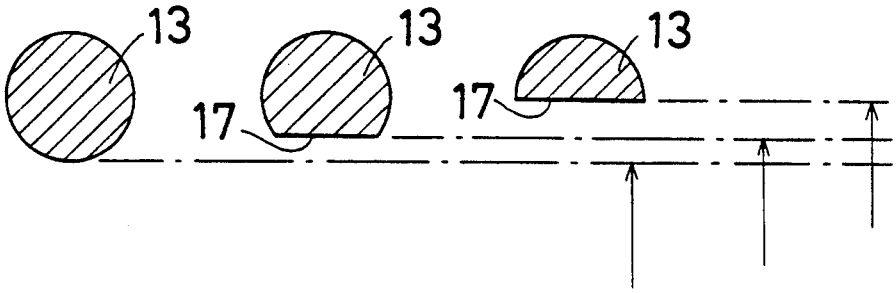
FIG. 9 is a cross section showing a pin as a stopping member.

In addition, the position of the inner end portion 15 of the core can be adjusted or changed relative to the central hole 5 of the main body in the female die, readily by changing the machined depth of the flat portion 17 in a manner illustrated in FIG. 9.

Second Embodiment

This embodiment is directed a further improvement of the combination die assembly 2 provided in the first embodiment.

Figure 13A:
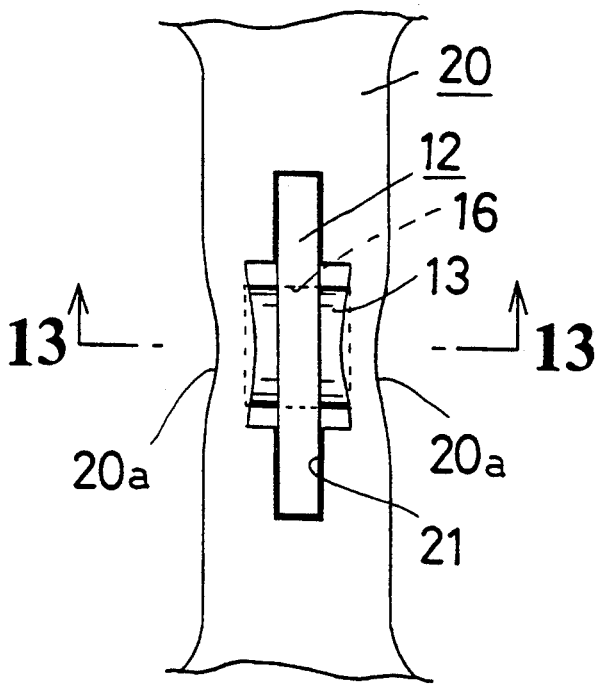
FIG. 13*a* is a rear elevation of a bridging member included in the second embodiment.
Figure 13B:
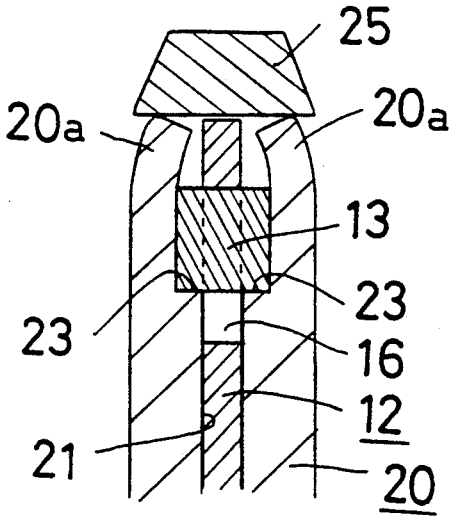
FIG. 13*b* is a cross section taken along the line 13—13 in FIG. 13*a;*

The die assembly 2 in the first embodiment is useful and satisfactory if the extrusion is not carried out under hard conditions. However, there is observed sometimes a certain type of deformation in the die assembly which has been used under an extremely severe condition. FIGS. 13*a* and 13*b* show an example of such a deformation, wherein outer or rearmost ends of the walls 20*a* of the bridging member 20 are bent towards each other due to a high pressure of the extruded material.

The deformation is caused by gaps which are present between the side surfaces of the core 12 and the surfaces facing one another and defining the outer end of the aperture 21 holding the core. It is noted in this connection that the stopping pin 13 is set in its entirety deep in the aperture 21, lest the outer or rear end of the core 12 is exposed out of said aperture in the first embodiment.

Such a deformation of the walls will bring about a problem when removing the used, occasionally worn, core 12 for replacement with a new core. The used core 12 will be hindered from slipping out of the aperture 21 as the side ends of the pin 13 interfere with the deformed walls 20*a*, thus rendering the operation considerably difficult or impossible.

The combination die assembly provided in accordance with the second embodiment is improved to be free from such a problem.

As shown in FIGS. 3*a* to 7*c*, a mold 14 for receiving a core in the die assembly 2 has a core-holding aperture 21, which is formed with guide grooves 22 of a depth different from those in the first embodiment. Shoulders 23 are similarly formed as the grooves' inner bottoms for engagement with a stopping pin 13. Those shoulders are desirably located such that the outer or rear surface of this pin, whose flat portion 17 rests on the shoulders, does protrude rearwardly of the rear surface of walls surrounding the aperture 21.

Alternatively, the depth of the shoulders 23 can be such that the pin 13 does not jut from the rear end of the aperture 21 but is very close thereto.

Figure 4:
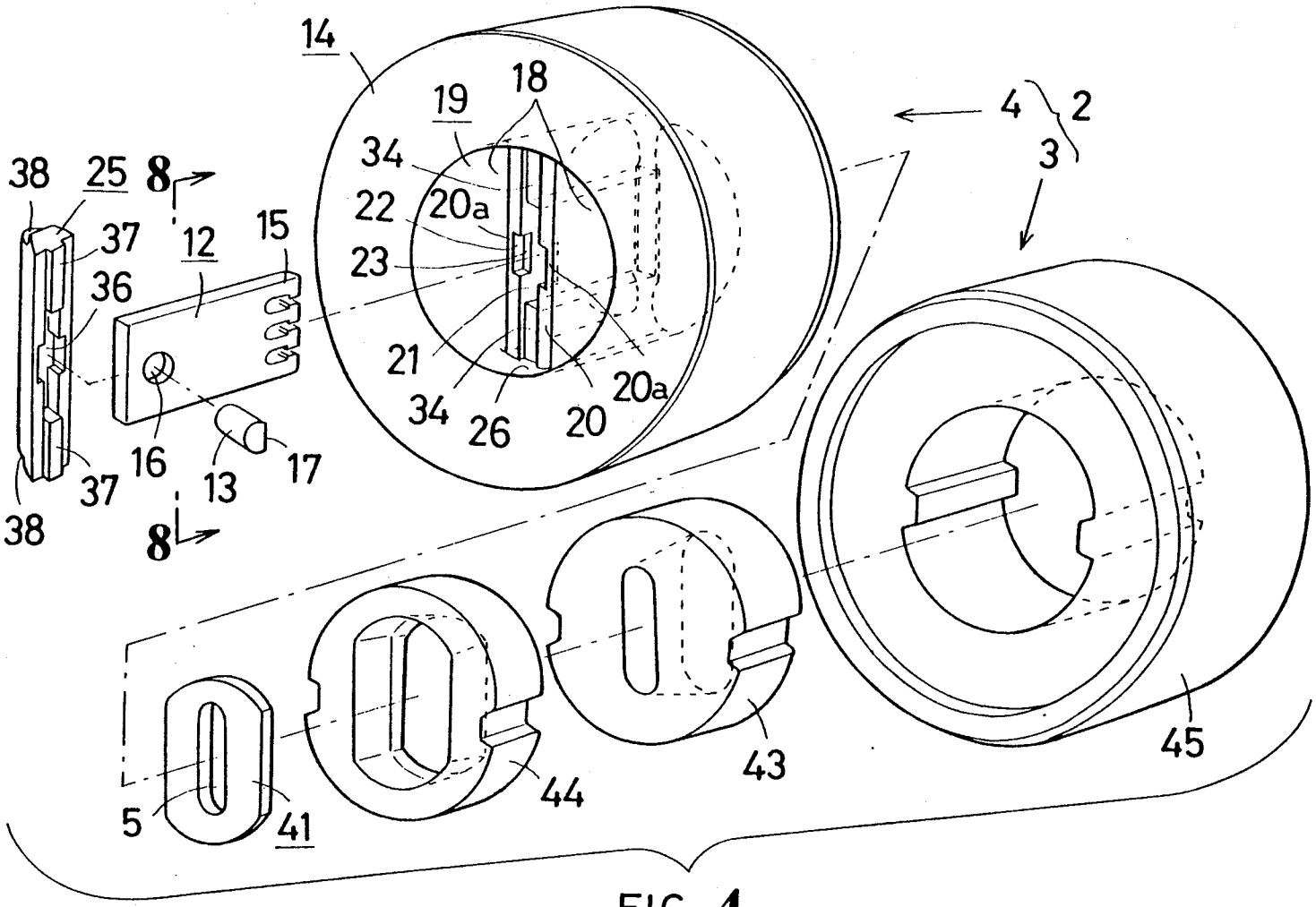
FIG. 4 is a perspective view showing the disassembled state of the combination die assembly shown in FIG. 3*a;*

The mold 14 for receiving the core has, as shown in FIG. 4, a bridging member 20 integral with the mold and is recessed forward to give a space 26 for receiving a rear cover 25. Shallow recesses 34 radially extend on the rear surface of the bridging member 20, in alignment with the rear end of the aperture 21.

Figure 3B:
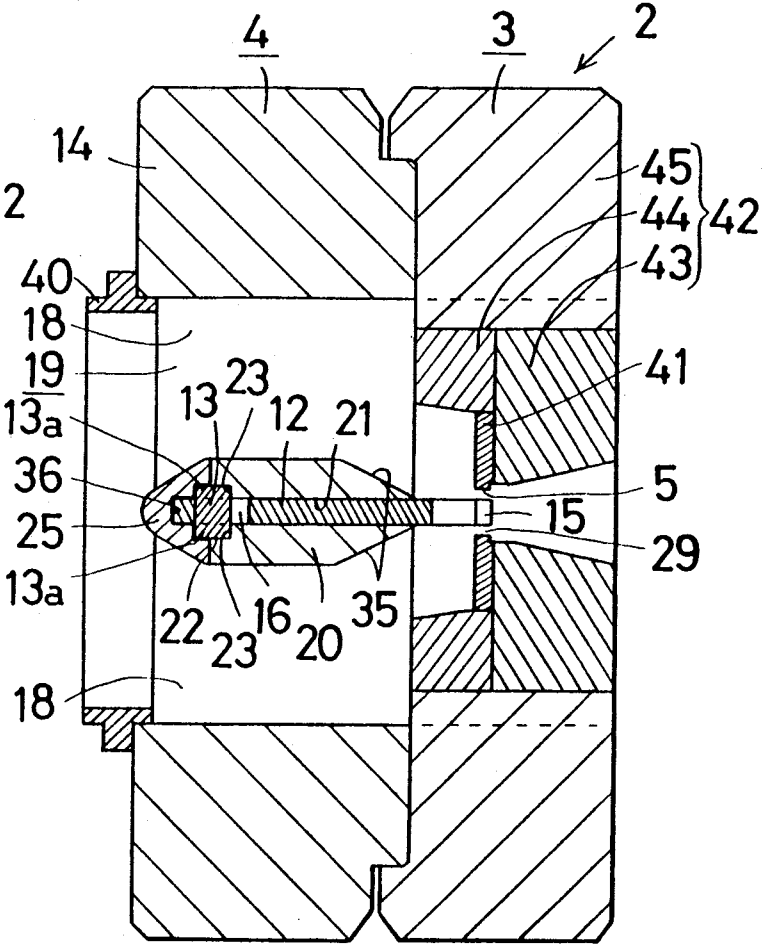
FIG. 3*b* is a cross section taken along the line 3—3 in FIG. 3*a;*

A front or inner end of the bridging member 20 is so slanted forwardly as to provide pressure-bearing areas 35 as shown in FIG. 3*b*, which areas are subjected to the backward pressure of the extruded material. Those area 35 are made broad enough for the bridging member 20 to strongly grip the core 12 during the extrusion process. This feature is advantageous in that the stress imparted to the stopping pin 13 is diminished to thereby decrease its diameter and the width of guide groove 22.

The rear cover 25, which is of such a shape and dimension as fitting in the space 26 at the rear end of the mold's bridging member 20, is also convex rearwardly so that the extruded material can be divided smooth into the distributaries 18 formed through the mold 14.

Figure 3A:
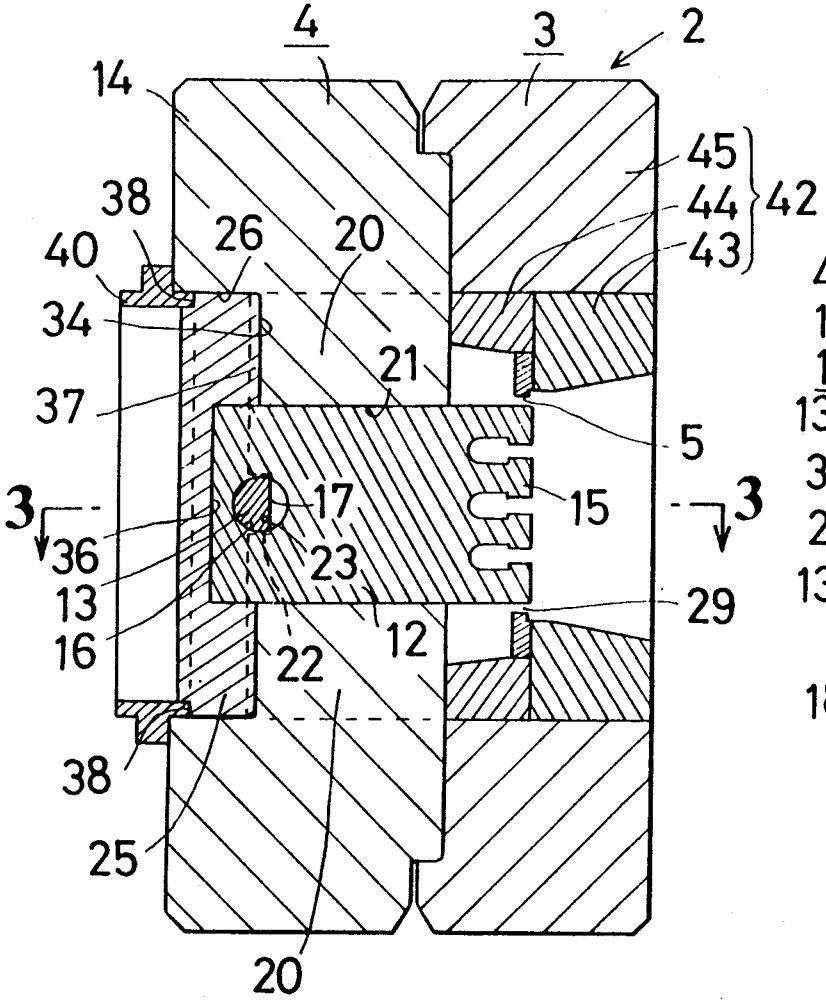
FIG. 3*a* is a horizontal cross section of a combination die assembly provided in a second embodiment.

FIG. 4 shows the front configuration of the rear cover 25, wherein a central recess 36 is designed to receive both the rearwardly jutting ends of the core 12 and pin 13, and side lugs 37 are formed beside the central recess so as to fit in the aforedescribed shallow recesses 34 of the bridging member 20. A ring 40 shown in FIGS. 3*a* and 3*b* is fitted in side rearward cutouts 38 of the cover 25.

The male die 4 may be assembled, in a manner similar to that in the first embodiment, by inserting at first the stopping pin 13 in and through the pierced opening 16 of the core 12. The core 12 is then pushed forward (i.e., inwardly) to slide into the core-holding aperture 21, until the flat cut surface 17 at the pin's side ends 13*a* come into contact with and are pressed to the shoulders 23 within the aperture 21.

With the core 12 inserted this way, the rear portion of the pin 13 juts outwardly of the bridging member's aperture 21 as illustrated in FIG. 6. The rear portion of the core 12 itself also juts backward with respect to the rear end of the aperture 21.

Then, the rear cover 25 is put in the space 26 formed rearwardly of the bridging member 20 so that the central recess 36 receives the rearward en portions of the core 12 and pin 13. At the same time, the shallow recesses 34 tightly receive therein the side lugs 37 in a state shown in FIGS. *7a* to *7c*, whereby the male die 4 is provided in its assembled state.

As for the female die 3, it comprises a bearing tip 41 and a tip holder 42, as is illustrated in FIGS. *3a*, *3b* and 4. The holder 42 comprises a back-up member 43, a ring-like member 44 and a mold 45, wherein the ring-like member 44 not only contributes to the flow rate control of extruded material but also forms a fusion chamber as in the first embodiment.

The male die 4 which is assembled in the described manner will be combined with the female die 3 to provide the combination die assembly 2. A continuous slit 29 is defined between the inner end portions 15 of the core 12 and an inner periphery of the female die's hole 5. The configuration of the slit corresponds to the cross-sectional shape of extruded tube 1. A ring 40 will be attached to the rear end of the die assembly 2. Then, an amount of molten aluminum or the like metallic material to be extruded will be poured into the die assembly before it is mounted on an extruder. Subsequently, the raw material in its solid state will be forced through and forwardly of the die assembly to continuously form a multi-bored flat tube 1.

The die assembly 2 in this second embodiment is more advantageous than that 2 in the first embodiment at the following points.

Figure 5:
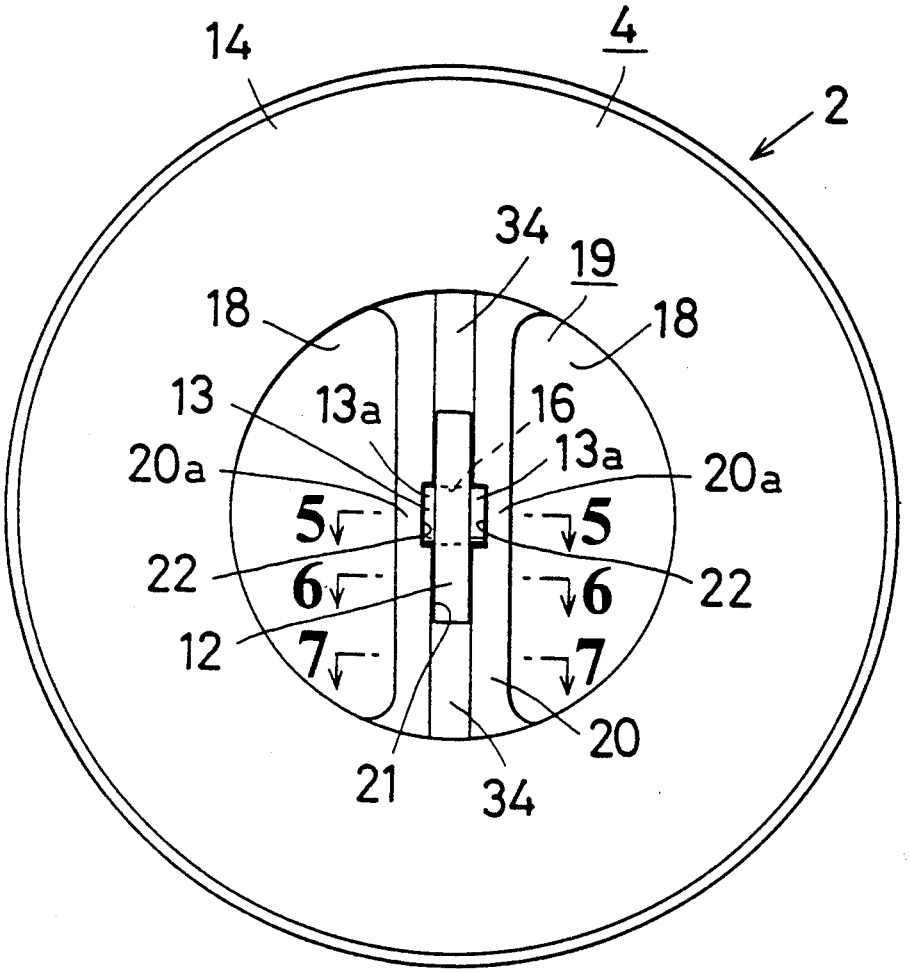
FIG. 5 is a rear elevation of the die assembly shown in FIG. 3*a*, with its rear cover being removed.

Firstly, the thin walls 20*a* surrounding the aperture 21 of the bridging member 20 in the male die 4 are protected well from undesirable deformation which would occur inwardly due to the pressure of extruded material, because the pin 13 supporting the core 12 within said aperture 21 has its rearward portion jutting rearwardly thereof as shown in FIG. 6, and thus has its both side ends do support the thin walls 20*a* as will be best seen in FIG. 5. The core 12 which will be worn at its inner end portions 15 in the course of use can now be replaced with a new one, without encountering any difficulty caused by the interference of the pin 13 with the walls 20*a*.

Secondly, since the shallow recesses 34 formed on the rear surface of the bridging member 20 tightly receive therein the side lugs 37 of rear cover 25, this cover which is securely fixed in place to the member's 20 rear end can be removed therefrom more easily than in the case of welded conjunction when the core 12 is to be replaced.

Thirdly, the cover 25 is free from any transversal deformation at its middle portion, displacement as a whole or droppage during the extrusion process even if any uneven stress or pressure is charged to the cover, because the front lugs 37 and rear recesses 34 extend almost the full length of the member 20 and the cover 25.

Fourthly, although the pin 13 is positioned so shallow that the rear end of the core 12 protrudes outwardly of the aperture 21, this core is protected from any damage or breakage which might be caused by the sideways deformation and interference of the cover 25 with the core 12. Such a sideways deformation of the cover is inhibited herein by the tight fitting of the lugs in the recesses just mentioned above.

Third Embodiment

Figure 10:
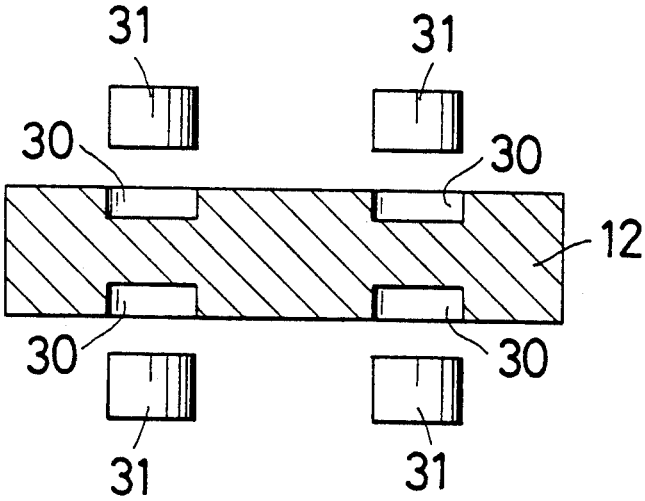
FIG. 10 is a cross-sectional view showing the pins disassembled from the core in a third embodiment.

The die assembly provided in the third embodiment is shown in part in FIG. 10, wherein recesses 30 are engraved on the side surfaces of the core 12, instead of the pierced opening in the already described embodiments. Each of tenon-like pins 31 fits in each recess 30 to support and hold the core 12 in place.

Fourth Embodiment

Figure 11:
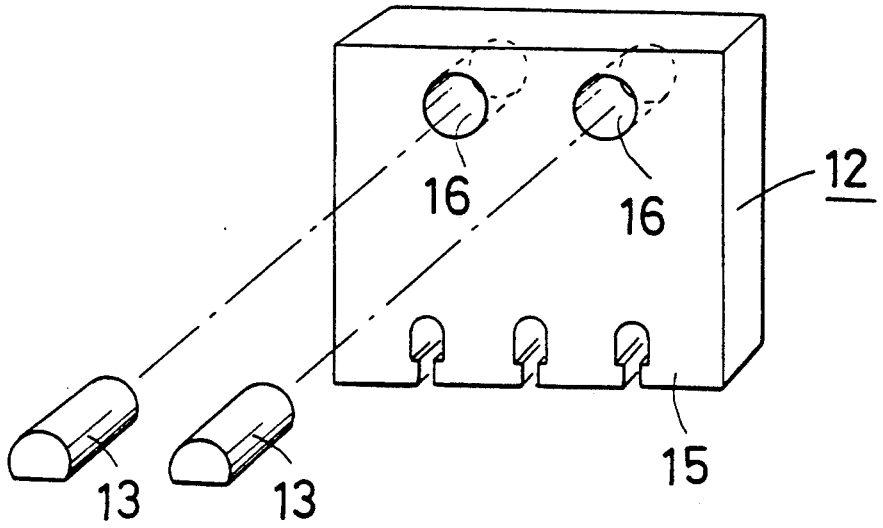
FIG. 11 is a perspective view showing the pins also disassembled from the core in a fourth embodiment.

In this embodiment partly shown in FIG. 11, a right and left openings 16 re formed through the core 12 so as to respectively receive the pins 13 supporting the core. Such a two-point support of said core is more stable and more reliable than the one-point support as in the foregoing embodiments. Instead, more than two openings may pierce the core for a much more reliable support thereof.

In summary, the die assembly provided in the present invention comprises one or more pins as the stopping members to hold the core in the aperture through the mold. Consequently, the core can easily be manufactured merely by piercing the openings whereby the manufacture cost is reduced for the separable type male die or the combination die assembly including same.

Due to the core supported by the stopping members which in turn are supported by shoulders formed in the aperture formed through the mold, a correct position of the core relative to the mold can be realized in the direction of extrusion easily without needing a high precision in manufacturing the core. Thus, the core and male die can be manufactured at a further reduced cost.

Moreover, the structure in which the core supported by the stopping members held in position by the mold is effective to avoid an undesirable concentration of stress onto the core during the extrusion process. This will improve the reliability in mechanical strength of the male die, so that replacement of the broken core will no more be required so often as in the prior art die assemblies and thereby reliably ensuring a long and stable running of the extruder.

The extrusion method which also is provided herein does employ the combination die assembly as described above is therefore advantageous in the production cost of the extruded articles.

What is claimed is:

1. A combination die assembly adapted for extrusion of a metallic material, the assembly comprises:

a female die for forming a periphery defining a hollow and elongate article;

a male die which mates the female die to form at least one hollow space extending through the elongate article, the male die comprising:

a core having at its inner end at least one projected portion of such a shape as defining the hollow space;

the core further having at least one pierced opening through or at least one engraved recess on a body portion of the core;

at least one stopping member disposed through the opening or in the recess of the core such that at least one side end of the stopping member protrude sideways from the side surface of the body portion of the core;

a mold having a core-holding aperture which is formed through the male die so as to extend from an outer extremity to an inner extremity thereof; and at least one shoulder formed in the core-holding aperture on an inner wall surface so as to face the male die's outer extremity which is disposed upstream of a flow of extruded metallic material, wherein the core is inserted in the core-holding aperture in such a state that the side end of the stopping member is born by the shoulder of said aperture so that the core is kept in place within the mold.

2. A combination die assembly as defined in claim 1, wherein the stopping member or each of the stopping members is a pin which is disposed through the opening or in the recesses of the core, and side ends of the pin protrude sideways from the core so as to be borne by the shoulders.

3. A combination die assembly as defined in claim 2, wherein the pin as the stopping member has its outer portion which partially protrudes outwards from, or is disposed close to, an outer surface area of the mold which area defines the entrance of the core-holding aperture.

4. A combination die assembly as defined in claim 2, wherein at least an outer region of inner periphery of each opening or recess is arcuate, and correspondingly, at least an outer region of outer periphery of each pin is also arcuate at its portion disposed in the opening or recess.

5. A combination die assembly as defined in claim 4, wherein each arcuate outer region of the pin periphery extends beyond its semicircumference.

6. A combination die assembly as defined in claim 1, 2 or 3, wherein the core is made of an especially hard and durable material such as a hard metal or ceramics.

7. A combination die assembly as defined in claim 1, 2 or 3, wherein the core-holding aperture is formed through a bridging member which is disposed across a flow path formed through the mold and allowing the metallic material to be extruded therethrough, and further comprising a rear cover disposed in rear of the bridging member, wherein the rear cover has on its front region one or more such lugs or recesses that engage with corresponding recesses or lugs on the rear region of said member, whereby said cover is kept in right position relative to the bridging member.

8. A method of extruding a metallic substance or the like to form an hollow and elongate article, the method comprising the steps of:

preparing a female die and a male die which is to mate the female die, with the female die being designed to form a periphery defining the hollow and elongate article, and with the male die cooperating with the female die to form at least one hollow space extending through the elongate article, the male die comprising: a core having at its inner end at least one projected portion of such a shape as defining the hollow space and further having at least one pierced opening through or at least one engraved recess on a body portion of the core; at least one stopping member disposed through the opening or in the recess of the core such that at least one side end of the stopping member protrude sideways from the side surface of the body portion of the core; a mold having a core-holding aperture which is formed through the male die so as to extend from an outer extremity to an inner extremity thereof; and at least one shoulder formed in the core-holding aperture on an inner wall surface so as to face the male die's outer extremity which is disposed upstream of a flow of extruded metallic material;

inserting the core into the core-holding aperture in such a state that the side end of the stopping member is born by the shoulder of said aperture so that the core is kept in place within the mold of the male die;

then combining the male die with the female die so as to form the combination die assembly;

subsequently mounting on an extruder the combination die assembly; and finally extruding the metallic material through the combination die assembly in a continuous manner.

9. The method as defined in claim 8, wherein the stopping member or each of the stopping members which constitute the die assembly is a pin disposed through the opening or in the recesses of the core, and side ends of the pin protrude sideways from the core so as to be born by the shoulders.

* * * * *